US005237952A

United States Patent [19]

Rowe

[11] Patent Number: 5,237,952

[45] Date of Patent: Aug. 24, 1993

[54] VARIABLE ATTITUDE SUBMERSIBLE HYDROFOIL

[76] Inventor: Thomas Rowe, 3611 Ricardo Ave., Redding, Calif. 96002

[21] Appl. No.: 879,416

[22] Filed: May 7, 1992

Related U.S. Application Data

[63] Continuation of Ser. No. 740,099, Aug. 5, 1991, abandoned, which is a continuation-in-part of Ser. No. 417,002, Oct. 3, 1989, Pat. No. D. 318,843.

[51] Int. Cl.[5] ..... B63G 8/18

[52] U.S. Cl. ..... 114/332; 114/280; 114/334; 114/338

[58] Field of Search ..... 114/257, 312, 313, 315, 114/323, 324, 325, 330, 331-334, 336, 337, 274, 271, 144 R, 152, 280

[56] References Cited

U.S. PATENT DOCUMENTS

| | | | |
|---|---|---|---|
| 9,389 | 11/1852 | Phillips | 114/330 |
| 739,734 | 9/1903 | Spear | 114/16 |
| 1,324,961 | 12/1919 | Grantham | 114/330 |
| 2,980,047 | 4/1961 | Korganoff et al. | 114/313 |
| 3,092,060 | 6/1963 | Reid | 114/313 |
| 3,099,913 | 8/1963 | Melton et al. | 61/69 |
| 3,183,871 | 5/1965 | Reder | 114/66.5 |
| 3,371,635 | 3/1968 | Seeley | 114/16 |
| 3,388,683 | 6/1968 | Barhite et al. | 114/16 |
| 3,429,287 | 2/1969 | Uram | 114/330 |
| 4,823,722 | 4/1989 | Gass | 114/333 |

*Primary Examiner*—Sherman Basinger

*Attorney, Agent, or Firm*—Richard C. Litman

[57] ABSTRACT

A watercraft having positive static buoyancy is provided which is operable both as a hydrofoil and submersible vessel. It is generally shaped in the form of a dolphin or porpoise, with the equivalent of fins acting as both navigation and attitude control mechanisms. Pectoral or forward fins provide hydrofoil struts when manipulated into one position and then are operable as diving planes when displaced into an alternate position. A dorsal fin provides supplemental rudder control. A pair of flukes or rear fins provide for pitch and/or dive control while the vessel operates in the submerged mode. These fins and a propulsion system are either manually or computer controlled by way of hand held joysticks and foot rudders. Submerged operation is achieved with an internal combustion motor by including an air compressor and air storage tank(s) with an air intake arrangement having automatically operable devices serving to open and close an air intake in response to exposure to water. The vessel also provides positive static buoyancy in the event of any systems failure while submerged. If the vessel incurs an impact, a rear hull section containing the fuel tank is jettisoned to avoid fire or explosion. The vessel is capable of limited ballistic flight above the surface of the water, due to a combination of relatively high subsurface velocities attainable and the natural positive buoyancy of the craft which may be used to enable it to break well clear of the surface.

18 Claims, 4 Drawing Sheets

VARIABLE ATTITUDE SUBMERSIBLE HYDROFOIL

CROSS REFERENCE TO RELATED APPLICATION

This application is a continuation in part of utility patent application Ser. No. 07/740,099 filed on Aug. 5, 1991 and now abandoned, which application was a continuation in part of design patent application Ser. No. 07/417,002 filed on Oct. 3, 1989 and issued as U.S. Pat. No. Des. 318,843 on Aug. 6, 1991.

FIELD OF THE INVENTION

The present invention relates generally to positively buoyant submersible hydrofoils. More particularly, the invention relates to submersible hydrofoils which travel on the surface at speeds in excess of 45 mph and below the surface at speeds in excess of 35 mph. The hull structure is generally cylindrical and takes on the general shape of a fish.

DESCRIPTION OF THE PRIOR ART

Watercraft which demonstrate hydrofoil and submersible characteristics are generally known. U.S. Pat. No. Des. 210,755 issued to Lang discloses a submersible watercraft. This design includes various fin construction, with forward and rearward fin mountings.

U.S. Pat. No. 9,389 issued to D. Phillips on Nov. 9, 1852 discloses a Submarine Vessel. It is a human powered submersible and has a universal rudder in a near 'fin' style configuration.

U.S. Pat. No. 739,734 issued to L. Y. Spear on Sep. 22, 1903 discloses a Submarine Boat. Horizontal fins are available which are manipulable from within the submarine. The manipulation causes the fin area to change.

U.S. Pat. No. 1,324,961 issued to F. G. Grantham on Dec. 16, 1919 discloses a Submarine Scouting Apparatus. The watercraft itself is shaped substantially like a fish and has rear and top fins. In the patented design one person is placed within the hull in the prone position. In this fashion the vessel is propelled and guided through the water using human power to rotate the propeller, adjust the rudder, and to circulate air. The device is to be made of aluminum and has a compressed air reservoir. Foul air is vented to the exterior of the craft through a valve.

U.S. Pat. No. 2,980,047 issued to A. Korganoff et al. on Apr. 18, 1961 discloses a Submarine Vessel Equipped With Hydrofoil Assembly. The device acts as an ordinary submarine below the surface until it emerges from under the water. At this point the submarine functions as a hydrofoil enjoying the speed and efficiency thereof.

U.S. Pat. No. 3,092,060 issued to D. V. Reid on Jun. 4, 1963 discloses a Flying Submarine. Retractable wings with internal ballast and a removable airplane propeller are shown and the craft can be considered an amphibian.

U.S. Pat. No. 3,429,287 issued to E. M. Uram on Feb. 25, 1969 discloses a Hydrofoil Semisubmarine. A shallow running submersible is shown as having an albacore type main hull and incorporating a surface piercing hydrofoil system. This device has a submerged portion and a non-submerged control structure which are connected by a dual hydrofoil assembly.

In addition, applicant is aware of the following patents uncovered in the course of the examination of applicant's now abandoned utility application Ser. No. 740,099:

U.S. Pat. No. 3,099,913 issued to D. F. Melton et al. on Aug. 6, 1963 discloses an Underwater Vehicle System. The device is remotely operated, unlike the present invention; includes tracks for operation across the sea bottom; and requires a cable link with a surface ship.

U.S. Pat. No. 3,183,871 issued to O. Reder on May 18, 1965 discloses a Speed Boat With Underwater Wings. The device is essentially a standard submarine with hydrofoils for surface travel. It is incapable of completely leaving the surface.

U.S. Pat. No. 3,371,635 issued to L. W. Seeley on Mar. 5, 1968 discloses a Submersible Vessel. The device is a true submarine, although somewhat limited in capability in comparison to military craft, and is incapable of the surface and above surface maneuvers of the present invention.

U.S. Pat. No. 3,388,683 issued to B. B. Barhite et al. on Jun. 18, 1968 discloses a Submersible Hull Including A Detachable Man-carrying Capsule. The structure and configuration are unlike that of the present invention, and the device is incapable of leaving the surface.

U.S. Pat. No. 4,823,722 issued to A. Gass on Apr. 25, 1989 discloses a Semi-Submersible Marine Craft. The craft is incapable of submerging completely below the water surface, nor is it capable of leaving the surface.

None of the above inventions and patents, taken either singly or in any combination, is seen to disclose the instant invention as claimed.

SUMMARY OF THE INVENTION

The present invention provides a novel unsinkable, high speed hydrofoil which is submersible and highly maneuverable. The hull body is shaped essentially like a dolphin with a pointed nose section and several radially disposed fins. The two forward fins are operable as hydrofoil struts and bring the majority of the hull out of the water. This reduces the hull frictional contact with the water and increases craft speed. These forward fins are mounted for variable pitch and dihedral and also act as diving planes in the submersible mode. Since an air breathing power plant is employed, air intake and air exhaust ports are provided. A major emphasis of the apparatus includes craft and pilot safety features. This includes durable, lightweight hull materials and a unique pilot restraint and airbag system, together with a jettisonable rear section containing the craft's fuel cell or tank. In the event of an extreme impact, the structure of the hull laminates provides a sequential disintegration of the structure (with the exception of the occupant compartment), beginning with the fuel tank or cell.

Accordingly, one object of the present invention is to provide a fast, one man submersible hydrofoil which can operate with surface speeds up to and in excess of 70 miles per hour and with subsurface speeds up to and in excess of 35 miles per hour.

Another object of the present invention is to provide a submersible hydrofoil that can leap out of the water to a jump height of 20 feet or more.

Another object of the present invention is to advance the state of the art in crash survivability for high speed watercraft, by providing a resilient sandwich construction of foam and composite materials as well as occupant padding and airbag protection.

Another object of the present invention is to provide a relatively low cost and safe submersible hydrofoil which can be utilized either as a recreational vessel, research watercraft or military vehicle and exhibits a high degree of maneuverability.

These and other objects of the present invention will become readily apparent upon further review of the following specification and drawings.

BRIEF DESCRIPTION OF THE DRAWINGS

Similar reference characters denote corresponding features throughout the several figures of the attached drawings.

DETAILED DESCRIPTION OF THE PREFERRED EMBODIMENT

Figure 1:
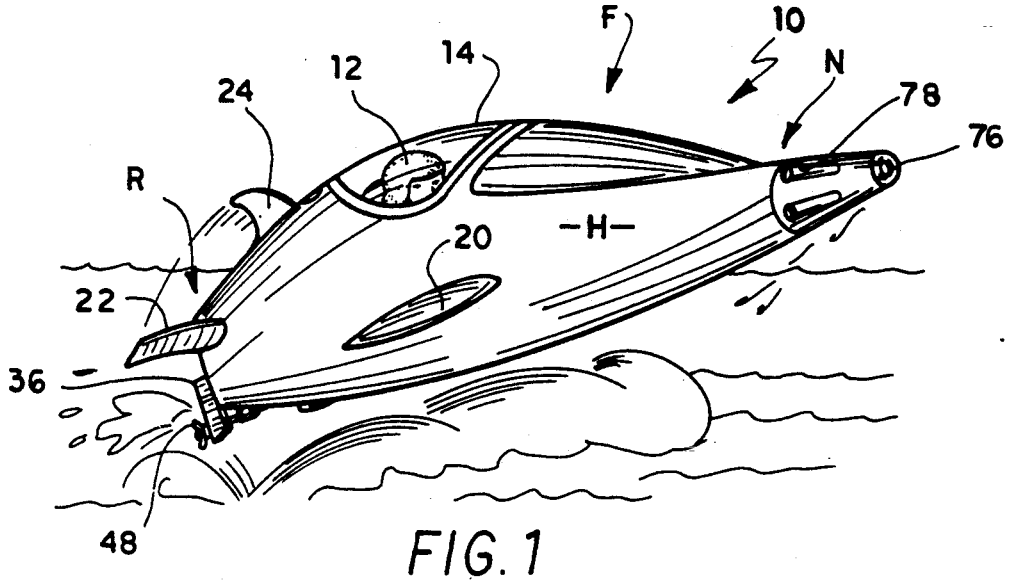
FIG. 1 is a perspective view of a vessels according to the present invention.

The variable attitude submersible hydrofoil 10, hereafter referred to as VASH, is preferably designed to be a positively buoyant, unsinkable craft which can travel both above and below the surface of the water. It is shaped essentially in the form of a dolphin, with a generally cylindrical cross-section terminating in a tapered nose or front N and a squared off rear or tail T. The VASH is essentially hollow and has a forward F and rear R compartment. The forward compartment F houses the pilot 12 and craft control systems and is entered through a removable canopy 14. The rear compartment R houses the propulsion and other mechanical support systems and can be accessed through a removable rear section or housing 18.

Projecting externally of the VASH are five substantially horizontal or vertical fins, a rudder and a multi-bladed propeller. The five fins include a pair of forward or front lateral fins 20 selectively displaceable to provide diving planes and hydrofoil struts, a pair of rear fins 22 acting as horizontal stabilizers, and a single, vertical dorsal fin 24 serving as a vertical stabilizer, particularly when the vessel operates in the submerged mode. These various fins are preferably provided with a symmetrical hydrofoil shape, in which the opposing cambers on each side are equal. Thus, each of the fins will provide equal efficiency in either direction of deflection.

Figure 3:
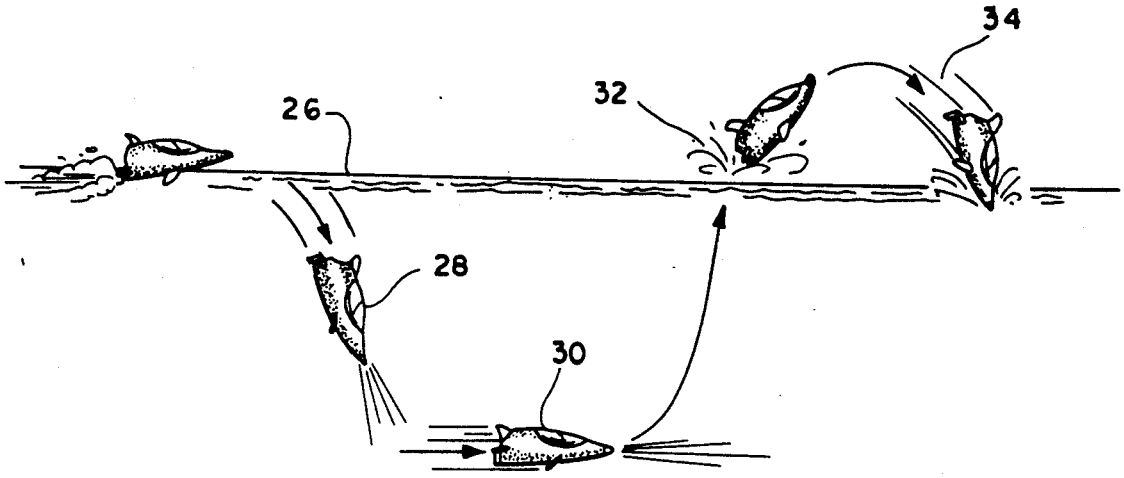
FIG. 3 is a side elevation illustrating the various attitudes under which the present invention may operate.
Figure 6:
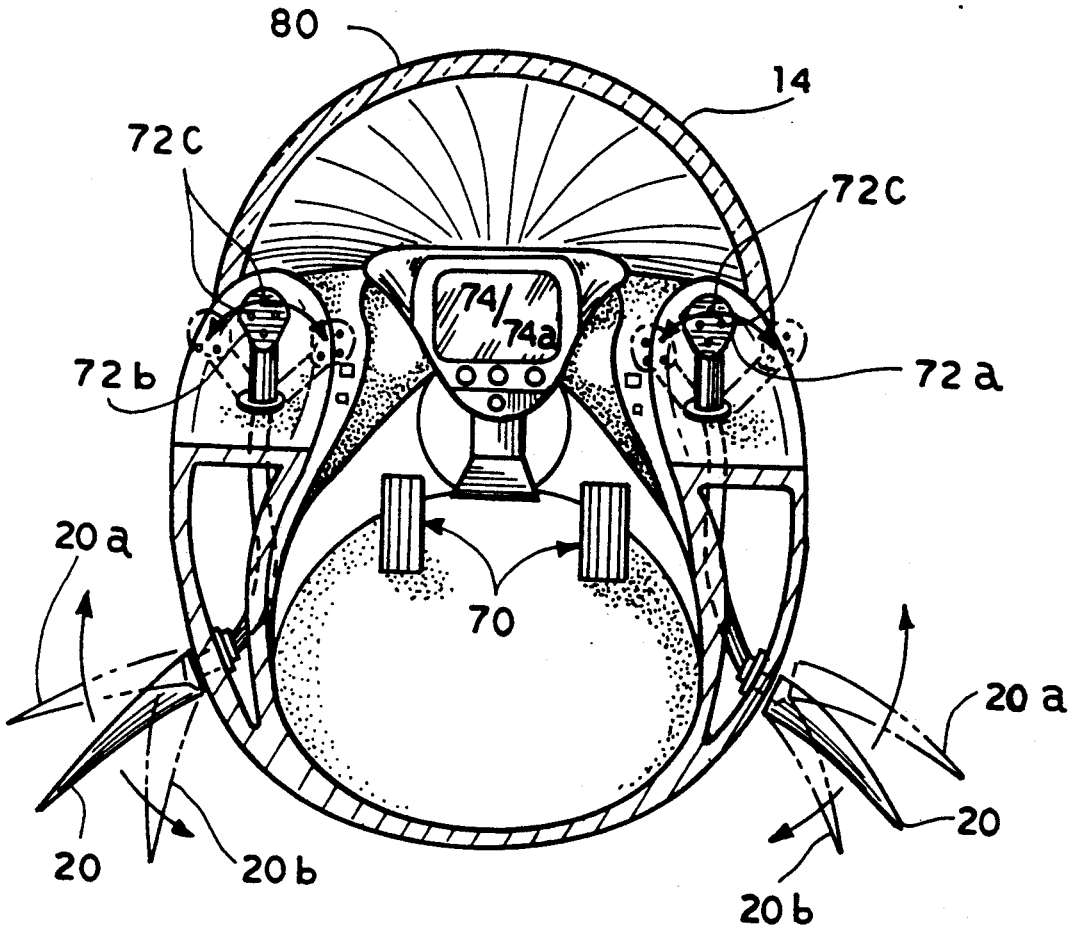
FIG. 6 is a vertical cross-sectional view through the cockpit illustrating the pilot's controls and the hydrofoil struts.

All of the fins are movable, at least about an axis through the fin body and which is disposed normal to the juxtaposed VASH body and these fins are controlled by stepper motors or hydraulics actuated by the pilot. The forward fins 20 serve a dual purpose. First, they can be raised or lowered by the pilot to act respectively as dive planes or as hydrofoil struts. In the lowered position 20B shown in FIG. 6, and at a high enough craft speed, the hull is raised out of water 26 allowing a greater velocity to be achieved. In the upper or raised position 20A these forward fins act as diving planes. As diving planes, these fins are rotated about their axes to change the angle of attack relative to the water. As the rotation brings the fins forward a net downward force is achieved, which force is capable of exceeding the static buoyancy of the craft. This causes the VASH to dive or submerge, as at 28 in FIG. 3. The fins can be leveled out and horizontal underwater motion as at 30 is obtained. When the fins are rotated in rearward fashion, a net upward force is produced which causes the VASH to surface, as depicted at 32.

The second or rearward pair of fins 22 are located on the hull below the removable rear housing 18 of the VASH. These fins act as horizontal stabilizers. When underwater, these fins add stability and give greater maneuvering capacity. They are controlled by the pilot by means of a stepper motor 23. For straight travel or to maintain a constant heading, the left and right front and rear fins are normally rotated equal amounts but obviously, the left and right fins can also be rotated at different angles to produce rolls. To accomplish a rapid rise, descent or jumping maneuvers as at 34, the front fins 20 may be tilted in one direction while the rear fins 22 are tilted in an opposite direction.

The vertical dorsal fin 24 is located on the rear of the VASH on top of the removable rear housing 18. It can be pivoted right or left about its substantially vertical axis and acts as a lateral directional control surface, primarily during underwater maneuvers although quite obviously during surface operation, directional control at a high rate of speed would also be augmented by manipulation of the fin 24. Both the rearmost rudder 36 and the dorsal fin 24 rotate in a synchronized fashion. When the VASH is above water, the rudder 36 provides the primary control of the right-left turning of the vessel. When below water, both the dorsal fin 24 and the rudder 36 control the right and left turning movements, or yaw, of the craft.

The rudder 36 is connected to the rear of the VASH by a pivotable U-shaped connector 37 which is secured by a vertical pivot pin 35, attaching the rudder to the rear hull by a plate 33 which is suitably affixed to both the hull and the pin.

The propulsion system of the VASH is located in the rear compartment R and typically may comprise a 100 horsepower marine inboard motor 38 which is accompanied by a bank of batteries 40 suitably charged by well-known alternator means driven by the motor 38. Above water, air is drawn in by means of an engine driven compressor 52 through the top-mounted air intake port 42 while exhaust gasses are dispelled through an external exhaust port conveniently discharging through the vehicle hull. A transmission 45 delivers the output of the motor to a propeller 48, by way of a drive shaft 46. These latter two elements are interconnected by a universal joint 49, with a stub drive shaft 47 journalled within the rudder 36, delivering the motor output to the aft-mounted propeller 48. In this manner, pivotal displacement of the rudder about an axis which passes through the universal joint 49, allows maintenance of continuity of the drive train, during maneuvers.

A compressor 52 is provided which draws in air through the air intake port 42 in the housing skin and delivers compressed air into one or more air storage tanks 54. The outside air 51 is drawn through a tube 51A connecting the air intake port 42 to the compressor 52. The compressed air is then directed through a high pressure conduit 53 to the compressed air storage tank 54. These storage tanks 54 provide combustion air for the engine when the VASH is submerged. The engine of the present embodiment is of a typical internal combustion type. The air is fed from the compressed air storage tank through an expansion valve 55 and then supplied to the motor 38 through an intake line 55A. A suitable exhaust pipe will be understood to be directed to the atmosphere.

Figure 4:
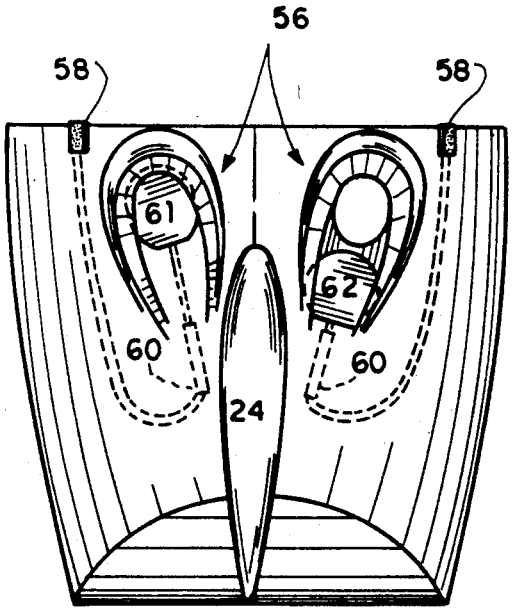
FIG. 4 is a top plan view of the air intake valves and sensor array as contained in the jettisonable rear body section.

As the vehicle transitions between surface and submerged modes, the air intake port 42 is opened or closed by a shutter type mechanism 56 as shown in FIG. 4. Sensors 58 detecting the presence of water are located on the hull rear housing upper surface and upon sensing water, solenoids 60 are actuated to close a pair of shutters 61–62 overlying the air intake port 42 prior to the VASH completely submerging. The air intake port 42 is opened when the sensors indicate the absence of water and then the shutters will both appear as at 62. On the other hand, when water is detected, the solenoids 60 close the shutters to the position as reflected at 61 in FIG. 4.

A fuel tank 64 is mounted within the inside of the rear housing unit 18 and straddles the compressor 52. In a high velocity impact, the rear housing section 18 is jettisoned, along with the fuel tank 64, to prevent an onboard fire or explosion.

Figure 2:
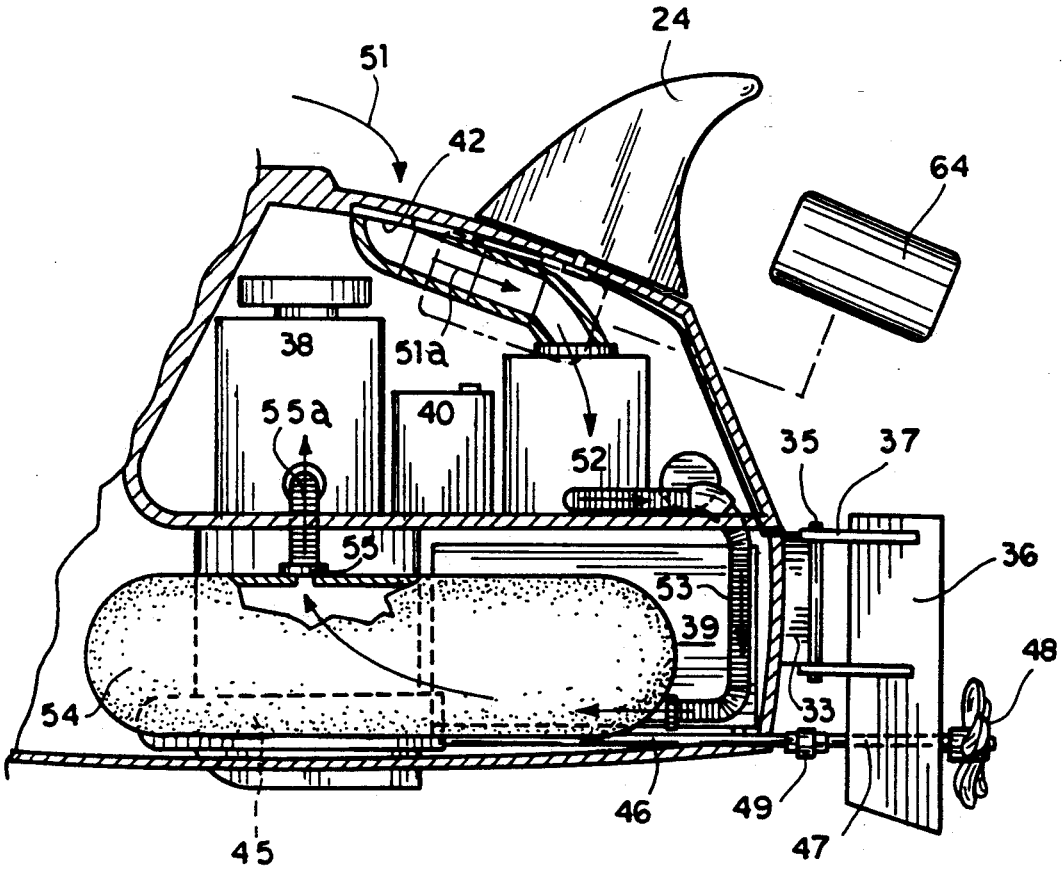
FIG. 2 is an enlarged vertical, cross-sectional view of the rear portion of the vessel of FIG. 1.
Figure 5:
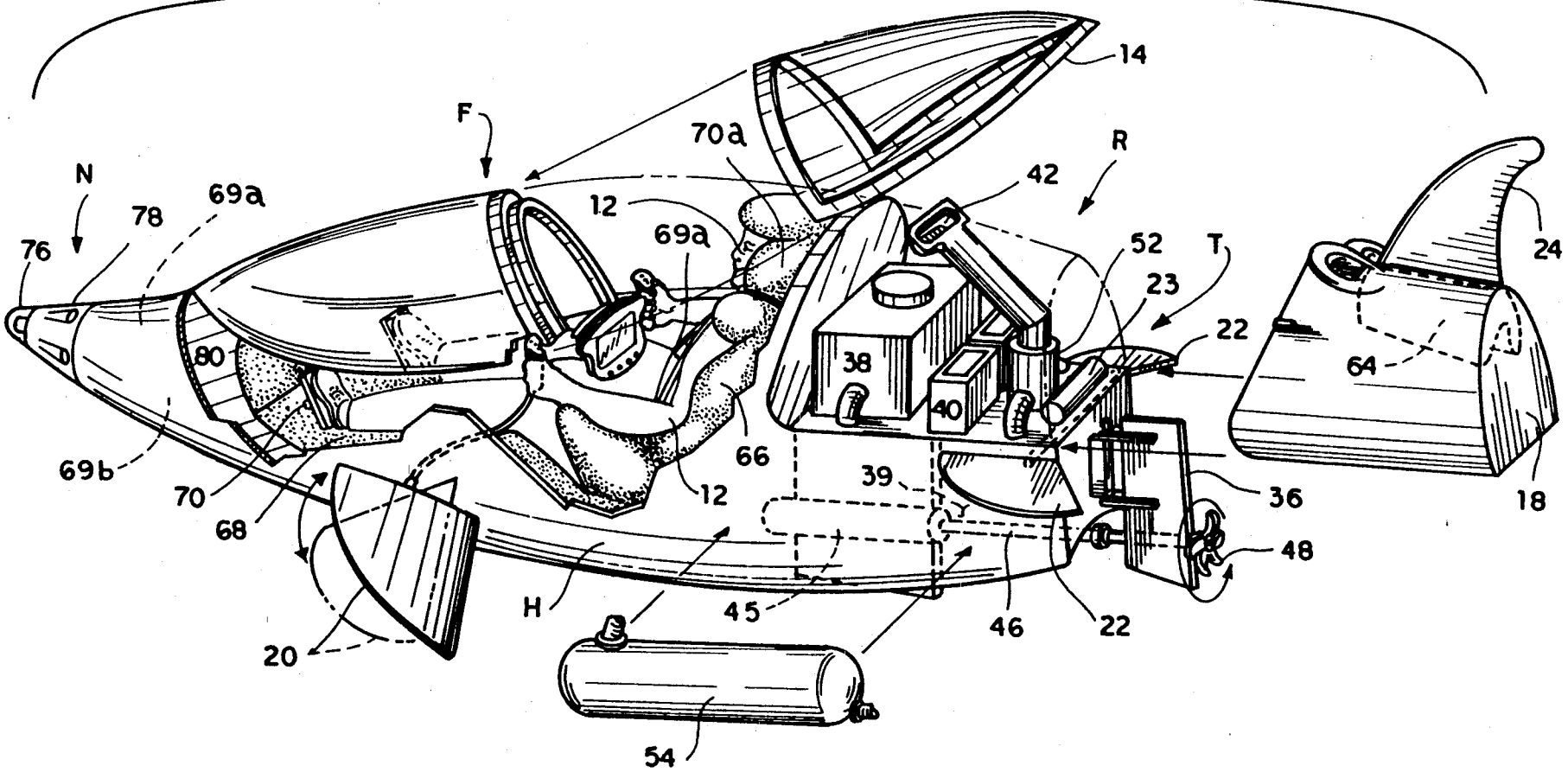
FIG. 5 is an exploded side perspective view of the preferred embodiment.

The engine can be a conventional internal combustion engine or it can be a modified engine which recycles its own exhaust gases for reuse. In order to provide somewhat longer duration when submerged, a scrubber-rebreather system 39 (FIGS. 2 and 5) may be included within the hull, preferably within the rear compartment R. A larger unit 39 may be incorporated within a lengthened compartment R, if desired. Such a closed or rebreather system when used with the VASH will substantially increase the duration of any underwater operation.

The forward compartment F will be seen to house the pilot 12. A recliner type chair 66 is provided having legs 68 stretching forward toward the nose area N. The chair is padded and the pilot is secured within it with by suitable restraint means such as a three-inch, five-point racing harness 69A. An adjustable padded head restraint 70A is provided in addition to air bag style seating.

A pedal system 70 is located near the nose which controls the rudder 36 and dorsal fin 24. Right 72A and left 72B joysticks are provided in easy reach of the hands. These hand controls are manipulated to actuate the throttle and acceleration as well as the aft and forward fins. Any desired hand motions may be translated through the hand controls 72A–72B to achieve this motor and fin actuation. For example, pivoting of the controls along a fore-aft axis may rotate the forward fins 20 about their axes while a left-right pivoting thereof changes the relative angle of attack of these fins. Switch buttons 72C on the two hand controls may serve to actuate the rear fins 22, dihedral control, and the motor throttle.

A computer 74 and a viewscreen 74A is mounted in the forward compartment and would be above the lap of the pilot. Additionally, an advanced wide angle sonar system 69A for obstacle avoidance is incorporated, as in the nose N, as well as communications gear 69B. A camera 76 is mounted in the tip of the nose adjacent to high powered underwater lights 78. The camera brings up an image on the viewscreen which can also be transmitted, by the communications gear, to a remote location.

The vessel's hull H is preferably made from a suitable synthetic high impact lightweight composite, such as KEVLAR, SPECTRA, carbon fiber epoxy or high impact plastic and is provided with internal positive foam flotation. A chemically setting mixture curing into an expanded foam plastic material 80 may be used to fill the appropriate hull areas during construction, or alternatively a material such as STYROFOAM or the like may be used. The front, pilot's canopy 14 is made from a suitable bullet resistant transparent material such as ½ inch LEXAN and has an internal liquid layer 80 sandwiched inside the LEXAN. When electrically stimulated, the liquid layer tints to a darker shade which cuts out glare from the sun. When above water, the tint would be increased to maximum in bright sunlight and altered accordingly to reflect outside conditions. Under water, the tint would be turned to a lower level. As depth increases, the need for light blocking is lessened and in most submerged conditions, illumination from the lighting 78 will be called upon.

The preferred embodiment of the VASH is twelve feet long and weighs about 400 pounds. The front canopy is bulletproof and can withstand 200 mph crashes or 200 foot dives. It is anticipated that the VASH can be deployed by air with a velocity retarding parachute, or it can be deployed from a support craft for 'oceanographic' research. The high surface and subsurface speeds plus its bulletproof construction makes the VASH ideal for covert waterborn operations.

The relatively high power provided, in combination with the relatively light weight, small size, and hydrodynamic design, all serve to permit relatively high speeds to be attained by the craft. Even without the incorporation of a scrubber-rebreather unit 39, the air capacity of tank 54 will allow the engine 38 to operate for some few minutes even though the craft is completely submerged, depending upon the power output of the engine. This is sufficient time to allow the craft to descend to relatively great depths by means of the downward hydrodynamic force developed by the control surfaces. When it is desired to return to the surface of the water, the natural buoyancy of the craft will provide sufficient upward velocity to cause the craft to actually break completely free of the surface, and continue through the air for a short distance in a ballistic arc before striking the water again in the manner of a porpoise. Even greater velocities may be attained for the airborne ballistic arc if the engine 38 is also used.

It is to be understood that the present invention is not limited to the sole embodiment described above, but encompasses any and all embodiments within the scope of the appended claims.

I claim:

1. A submersible hydrofoil vessel comprising;

a hull having a forward section and a rear section, propulsion means within said rear section, a jettisonable rear housing in said rear section, a fuel tank within said rear housing, said forward section including a pilot compartment having control means therein, a pair of forward fins extending substantially laterally from said hull, a pair of rear fins extending laterally from said hull, displaceable vertically disposed control surfaces on said rear section, said forward fins displaceable between an upper substantially horizontal position and a lower angular position, said forward fins additionally displaceable between alternate pitch angles, said control means manipulatable to actuate said forward fins, rear fins and control surfaces, whereby said submersible hydrofoil vessel is operable as a hydrofoil while surfaced with said forward fins displaced to said lower angular position and is alternately operable as a submersible vessel with said forward fins displaced to said upper substantially horizontal position.

2. A completely submersible hydrofoil vessel having permanent positive static buoyancy and operable in a water environment, said vessel comprising;

a hull having a forward section and a rear section, engine propulsion means within said rear section capable of providing dynamic force and forward motion to propel said vessel, said forward section including a pilot compartment having engine and other control means therein, fixed, permanent internal flotation means providing positive static buoyancy, a pair of forward fins extending substantially laterally from said hull and capable of providing hydrodynamic down force, a pair of rear fins extending laterally from said hull, displaceable vertically disposed control surfaces on said rear section, said forward fins displaceable between an upper substantially horizontal position and a lower angular position, said forward fins additionally displaceable between alternate pitch angles, said control means manipulatable to actuate said forward fins, rear fins and control surfaces, whereby said completely submersible hydrofoil is operable as a hydrofoil while surfaced with said forward fins displaced to said lower angular position and powered by said engine and is alternately operable as a completely submersible vessel by means of said dynamic force provided by said engine with said forward fins displaced to said upper substantially horizontal position to provide said hydrodynamic down force while in said forward motion.

3. A completely submersible hydrofoil vessel according to claim 2 wherein, said engine propulsion means in combination with said positive static buoyancy provides sufficient said dynamic force to enable said vessel to ballistically depart said water environment for limited periods.

4. A completely submersible hydrofoil vessel according to claim 3 including, a drive shaft operable by said propulsion means and extending to said rudder, a propeller on said drive shaft rearwardly of said rudder, said propeller including a main section joined to a rear section by a universal joint, and said rear drive shaft section carried by said rudder.

5. A completely submersible hydrofoil vessel according to claim 2 wherein, said vertically disposed control surfaces on said rear section include a rear-most rudder.

6. A completely submersible hydrofoil vessel according to claim 2 wherein, said vertically disposed control surfaces on said rear section include a top-most dorsal fin.

7. A completely submersible hydrofoil vessel according to claim 2 wherein, said pair of forward fins, said pair of rear fins, and said displaceable vertically disposed control surfaces are provided with symmetrical opposite surfaces.

8. A completely submersible hydrofoil vessel according to claim 2 wherein, said hull defines a configuration substantially mimicking that of a fish.

9. A completely submersible hydrofoil vessel according to claim 2 wherein, said propulsion means comprises an internal combustion engine, an air compressor and air storage tank within said rear section, an air inlet through said hull communicating with said air compressor, and shutter means operable to alternately open and close said air inlet.

10. A completely submersible hydrofoil vessel according to claim 2 including, a scrubber-rebreather system located within said hull and providing air for said engine propulsion means.

11. A completely submersible hydrofoil vessel according to claim 2 including, a jettisonable rear housing in said rear section, and a fuel tank within said rear housing, whereby should said vessel encounter an impact, said rear housing and said fuel tank are jettisoned.

12. A completely submersible hydrofoil vessel according to claim 2 wherein, said control means includes a pair of foot engageable rudder pedals.

13. A completely submersible hydrofoil vessel according to claim 2 wherein, said control means includes a pair of hand engageable wobble sticks.

14. A completely submersible hydrofoil vessel according to claim 2 including, a canopy atop said pilot compartment, said canopy including a light-sensitive internal fluid layer electronically controlled to automatically provide a tint gradient proportional to the ambient light.

15. A completely submersible hydrofoil vessel according to claim 2 wherein, said hull is fabricated from KEVLAR.

16. A completely submersible hydrofoil vessel according to claim 2 wherein, said hull is fabricated from carbon fiber and epoxy.

17. A completely submersible hydrofoil vessel according to claim 2 wherein, said hull is fabricated from high impact plastic.

18. A completely submersible hydrofoil vessel according to claim 2 wherein, said permanent positive static buoyancy is provided by a chemically setting mixture curing into an expanded foam plastic material, said material molded and formed within said hull.

* * * * *